US006862416B2

(12) United States Patent
Hashiguchi et al.

(10) Patent No.: US 6,862,416 B2
(45) Date of Patent: Mar. 1, 2005

(54) IMAGE HEATING APPARATUS AND IMAGE FORMING APPARATUS

(75) Inventors: Shinji Hashiguchi, Shizuoka (JP); Hiroshi Kataoka, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 51 days.

(21) Appl. No.: 10/456,795

(22) Filed: Jun. 9, 2003

(65) Prior Publication Data

US 2004/0028423 A1 Feb. 12, 2004

(30) Foreign Application Priority Data

Jun. 11, 2002 (JP) ..... 2002-169503

(51) Int. Cl.[7] ..... G03G 15/20

(52) U.S. Cl. ..... 399/69; 399/68; 399/45; 399/43

(58) Field of Search ..... 399/43, 44, 45, 399/67, 68, 69, 320, 322, 328; 219/216

(56) References Cited

U.S. PATENT DOCUMENTS

| | | | | |
|---|---|---|---|---|
| 5,148,226 | A | 9/1992 | Setoriyama et al. | |
| 5,149,941 | A | 9/1992 | Hirabayashi et al. | 219/216 |
| 5,210,579 | A | 5/1993 | Setoriyama et al. | |
| 5,525,775 | A | 6/1996 | Setoriyama et al. | 219/216 |
| 5,904,871 | A | 5/1999 | Sakai et al. | 219/216 |
| 6,002,106 | A | 12/1999 | Kataoka et al. | 219/216 |
| 6,115,563 | A | 9/2000 | Miyamoto | 399/67 |
| 6,316,757 | B1 | 11/2001 | Kim et al. | 219/680 |
| 6,388,915 | B1 | 5/2002 | Kato et al. | 365/145 |
| 6,438,348 | B2 | 8/2002 | Kobaru et al. | 399/333 |
| 6,466,751 | B1 * | 10/2002 | Kawano | 399/68 |
| 6,687,469 | B2 * | 2/2004 | Takane | 399/45 |
| 2003/0029853 | A1 | 2/2003 | Izawa et al. | 219/216 |

FOREIGN PATENT DOCUMENTS

| | | |
|---|---|---|
| JP | 63-313182 | 12/1988 |
| JP | 4-44075 | 2/1992 |
| JP | 4-44076 | 2/1992 |
| JP | 4-44077 | 2/1992 |
| JP | 4-44078 | 2/1992 |
| JP | 4-44079 | 2/1992 |
| JP | 4-44080 | 2/1992 |
| JP | 4-44081 | 2/1992 |
| JP | 4-44082 | 2/1992 |
| JP | 4-44083 | 2/1992 |
| JP | 4-204980 | 7/1992 |
| JP | 4-204981 | 7/1992 |
| JP | 4-204982 | 7/1992 |
| JP | 4-204983 | 7/1992 |
| JP | 4-204984 | 7/1992 |
| JP | 11-143291 | 5/1999 |
| JP | 2001-263679 | 9/2001 |
| JP | 2002-157878 | 5/2002 |

* cited by examiner

*Primary Examiner*—Hoang Ngo
(74) *Attorney, Agent, or Firm*—Fitzpatrick, Cella, Harper & Scinto

(57) ABSTRACT

An image heating apparatus which heats an image on a recording material by holding and conveying the image-borne recording material at a nip between heating and pressure members has a sequence to set a heating temperature of the apparatus to be lower than an ordinary set temperature when, after the recording material of a width narrower than a predetermined width was passed, the recording material of a width wider than that width is passed. The set heating temperature when the wide-width recording material is passed after the narrow-width recording material was passed is controlled according to the number of the passed narrow-width recording materials and an elapsed time from the passing of the narrow-width recording material to the passing of the wide-width recording material, whereby hot off-set occurring when the large size recording material is passed after the small size recording material was passed is prevented without deteriorating fixability.

18 Claims, 13 Drawing Sheets

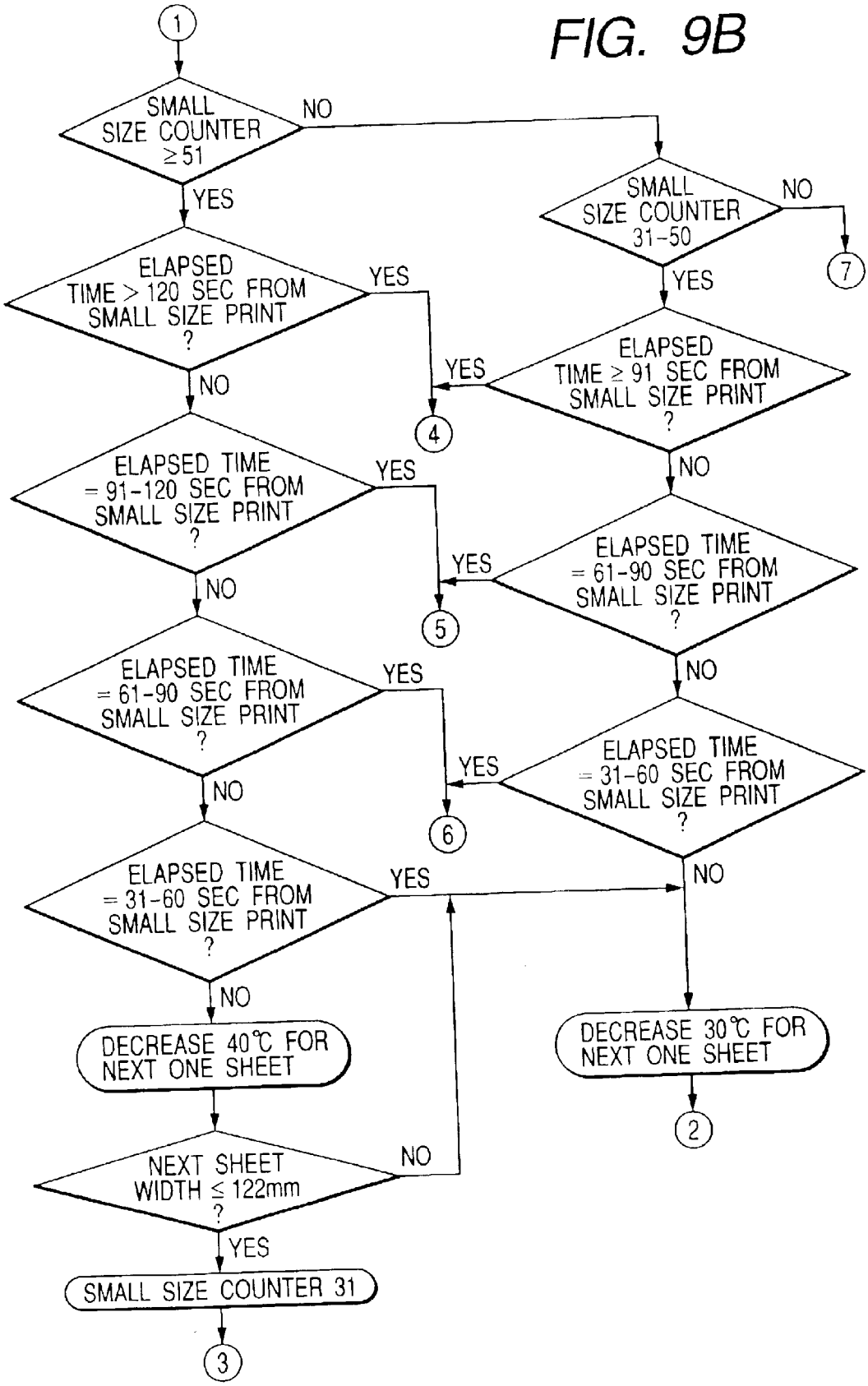
FIG. 9B
1
SMALL SIZE COUNTER ≥ 51
NO
YES
SMALL SIZE COUNTER 31-50
NO
7
YES
ELAPSED TIME > 120 SEC FROM SMALL SIZE PRINT ?
YES
NO
ELAPSED TIME ≥ 91 SEC FROM SMALL SIZE PRINT ?
YES
4
NO
ELAPSED TIME = 91-120 SEC FROM SMALL SIZE PRINT ?
YES
NO
ELAPSED TIME = 61-90 SEC FROM SMALL SIZE PRINT ?
YES
5
NO
ELAPSED TIME = 61-90 SEC FROM SMALL SIZE PRINT ?
YES
NO
ELAPSED TIME = 31-60 SEC FROM SMALL SIZE PRINT ?
YES
6
NO
ELAPSED TIME = 31-60 SEC FROM SMALL SIZE PRINT ?
YES
NO
NO
DECREASE 40℃ FOR NEXT ONE SHEET
DECREASE 30℃ FOR NEXT ONE SHEET
2
NEXT SHEET WIDTH ≤ 122mm ?
NO
YES
SMALL SIZE COUNTER 31
3

IMAGE HEATING APPARATUS AND IMAGE FORMING APPARATUS

BACKGROUND OF THE INVENTION

1. Field of the Invention

The present invention relates to an image heating apparatus which heats an image borne on a recording material (such as a fixing apparatus which heats and fixes an unfixed image on the recording material as a permanent image, a heating apparatus which temporarily fixes an unfixed image on the recording material, a heating apparatus which modifies an image surface property such as gloss or the like by reheating the recording material bearing an image, or the like), and an image forming apparatus which is equipped with the above image heating apparatus.

2. Related Background Art

Conventionally, as a heating/fixing means to be provided in an electrophotographic image forming apparatus such as a copying machine, a printer, a fax machine or the like, it adopts a heat roller heating/fixing apparatus of a contact-heating type which has excellent heat efficiency and safety, a film heating heating/fixing apparatus of an energy-saving type which has a quick-start property (on-demand property) and suppresses power consumption as much as possible by suspending power supplying to the apparatus at standby time, and the like.

The heat roller heating/fixing apparatus includes a rotative fixing roller which acts as a heating member heated by a built-in heat source such as a halogen heater or the like and controlled to a predetermined temperature and a rotative pressure roller which acts as a pressure member being in contact with the fixing roller in a predetermined manner, and heats and fixes an unfixed image borne on the surface of a recording material by introducing the recording material into a pressure-contact nip portion (fixing nip portion) formed between the rotative fixing roller and the rotative pressure roller and then holding tight and conveying the recording material at the nip portion.

On one hand, the film heating heating/fixing apparatus has been proposed in Japanese Patent Application Laid-Open No. 63-313182, Japanese Patent Application Laid-Open No. 01-263679, Japanese Patent Application Laid-Open No. 02-157878, Japanese Patent Application Laid-Open Nos. 04-044075 to 04-044083, and the like. That is, in the film heating heating/fixing apparatus, a heat-resisting film which acts as a movement member is tightly pressed against a heating element by the pressure member and then driven, the recording material is introduced between the heat-resisting film and the pressure member at a pressure-contact nip portion (fixing nip portion) which is formed by the heating element and the pressure member through the heat-resisting film, and the recording material is then passed the fixing nip portion together with the heat-resisting film in the situation that the recording material is tightly in contact with the heat-resisting film. Thus, heat from the heating element is transferred to the recording material through the heat-resisting film, whereby the unfixed image is heated and fixed to the surface of the recording material.

In such heating/fixing apparatuses as above, in a case where recording materials (small size media) of which the width is narrower than the maximum sheet passing width of the apparatus are continuously passed and the heating/fixing operation to the passed recording materials is continued, a temperature of the area in the fixing nip portion where the recording material is not passed (called a non-sheet passing area) keeps increasing because there is no medium for absorbing heat in the non-sheet passing area. On one hand, a temperature of the area in the fixing nip portion where the recording material is passed (called a sheet passing area) is maintained to a predetermined fixing temperature by a temperature control system, whereby so-called a non-sheet passing portion excessive temperature increase phenomenon that a temperature difference between the non-sheet passing area and the sheet passing area in the fixing nip portion increases occurs (FIG. 12).

Here, it should be noted that the horizontal axis of the graph shown in FIG. 12 indicates a time, and the print on the small size sheets is continuously performed in the area described as "small size print." Immediately after the small size print area, the print on the standard size sheets is continuously performed in the area described as "standard size print." At this time, the temperatures on the non-sheet passing area and the sheet passing area are measured. That is, the graph shown in FIG. 12 indicates that the temperature increase of the non-sheet passing area is higher than that of the sheet passing area.

In the above non-sheet passing portion excessive temperature increase phenomenon, when the print is performed on the recording material (large size medium) of which the width is wider than that of the above recording material, a longitudinal direction temperature distribution in the fixing nip portion is indicated as in FIG. 13. That is, the temperature of the small size sheet passing area is maintained to a predetermined fixed temperature, an excellent fixed image can be obtained in the image area corresponding to the small size sheet passing area. However, due to the print of the recording material of the narrow width, the temperature of the non-sheet passing area has increased up to the temperature higher than the set temperature of the sheet passing area, whereby hot-offset due to excessive fixing occurs in the image area corresponding to the small size non-sheet passing area.

Moreover, an amount of the moisture evaporated from the sheet (paper) being the recording material increases when the temperature of the pressure roller extraordinarily increases in the non-sheet passing area, whereby there is a problem that the recording material slips because the conveyance force of the pressure roller is lost.

In a sequence for performing the print on the recording material of the wide width after performing the print on the recording material of the narrow width so as to prevent the hot off-set (Japanese Patent Application Laid-Open No. 11-143291), when a time elapsed from the end of the passing of the recording material of the narrow width to the beginning of the passing of the recording material of the wide width is short, the temperature in the nip at the time when the standard size (large size medium) print is performed is as indicated by a curve (1) of FIG. 14, whereby an excellent image in which the hot off-set can be prevented and sufficient fixability is secured can be obtained. However, when the time elapsed from the end of the passing of the recording material of the narrow width to the beginning of the passing of the recording material of the wide width is long, although the same temperature control as that in the case where the elapsed time is short in the small size sheet passing area is performed, the temperature of the pressure roller has become low, whereby there is a problem that the fixability of the sheet passing area resultingly deteriorates as indicated by a curve (2) of FIG. 14 because the fixing temperature is excessively decreased.

SUMMARY OF THE INVENTION

An object of the present invention is to solve the above problem, that is, to prevent without deteriorating fixability that hot off-set occurs in a case where a large size recording material is passed after a small size recording material was passed in an image heating apparatus as represented by an image heating/fixing apparatus or an image forming apparatus which is equipped with the above image heating apparatus.

The image heating apparatus and the image forming apparatus according to the present invention include the following structures so as to solve the above problem.

(1) The image heating apparatus which heats an image borne on a recording material by holding tight and conveying the recording material bearing the image at a nip formed between a heating member and a pressure member, including a sequence, in a case where, after the recording material of the width narrower than a maximum sheet passing width of the apparatus was passed, the recording material of the width wider than that width is passed, for setting a heating temperature of the apparatus to be lower than an ordinary set temperature, and wherein the set heating temperature at the time of the passing of the recording material of the wider width after the passing of the recording material of the narrower width becomes low in proportion as the number of the passed recording materials of the narrower width becomes large and a time from the end of the passing of the recording material of the narrower width to the beginning of the passing of the recording material of the wider width becomes short.

(2) The image heating apparatus which includes a flexible movement member, a support member having a slide surface sliding on the movement member and supporting the movement member, and a pressure member forming a nip together with the support member through the movement member, and heats an image borne on a recording material by slidingly moving the movement member on the surface of the support member at the nip and then holding tight and conveying the recording material bearing the image between the movement member and the pressure member at the nip, including a sequence, in a case where, after the recording material of the width narrower than a maximum sheet passing width of the apparatus was passed, the recording material of the width wider than that width is passed, for setting a heating temperature of the apparatus to be lower than an ordinary set temperature, and wherein the set heating temperature at the time of the passing of the recording material of the wider width after the passing of the recording material of the narrower width becomes low in proportion as the number of the passed recording materials of the narrower width becomes large and a time from the end of the passing of the recording material of the narrower width to the beginning of the passing of the recording material of the wider width becomes short.

(3) The image heating apparatus described in (1) or (2), wherein a heating element exists on the portion corresponding to the nip of the support member, and the image borne on the recording material is heated by the heating element through the movement member.

(4) The image heating apparatus described in any one of (1) to (3), wherein, in a case where the heating temperature of the recording material of the wider width which has been set to be lower than the ordinary set temperature is returned to the ordinary set temperature, that heating temperature is increased stepwise.

(5) The image heating apparatus described in any one of (1) to (4), wherein a time to hold the sequence for setting the heating temperature to be lower than the ordinary set temperature in the case where the recording material of the wider width is passed after the recording material of the narrower width was passed is made different according to the number of the passed recording materials of the narrower width.

(6) The image heating apparatus described in any one of (1) to (5), wherein the image borne on the recording material to be passed in the nip is an unfixed image.

(7) The image forming apparatus which includes an image forming means for forming and bearing an unfixed image on a recording material and a heating/fixing means for heating and fixing the unfixed image onto the recording material as a permanent image, wherein the heating/fixing means is the image heating apparatus described in any one of (1) to (6).

That is, the apparatus includes a sequence, in a case where, after the recording material of the width narrower than a maximum sheet passing width of the apparatus was passed, the recording material of the width wider than that width is passed, for setting a heating temperature of the apparatus to be lower than an ordinary set temperature, and performs control so that the set heating temperature at the time of the passing of the recording material of the wider width after the passing of the recording material of the narrower width becomes low in proportion as the number of the passed recording materials of the narrower width becomes large and a time from the end of the passing of the recording material of the narrower width to the beginning of the passing of the recording material of the wider width becomes short, whereby an excellent image in which the hot off-set can be prevented and sufficient fixability is secured can be obtained irrespective of an interval from the print of the recording material of the narrower width to the print of the recording material of the wider width.

Moreover, when the heating temperature of the recording material of the wider width which has been set to be lower than the ordinary set temperature is returned to the ordinary set temperature, that heating temperature is increased stepwise, whereby the fixability can be further improved as preventing the hot off-set.

DESCRIPTION OF THE PREFERRED EMBODIMENTS

<First Embodiment>

Hereinafter, the preferred embodiment of the present invention will be explained in detail with reference to the attached drawings.

(I) Explanation of Image Forming Apparatus

Figure 1:
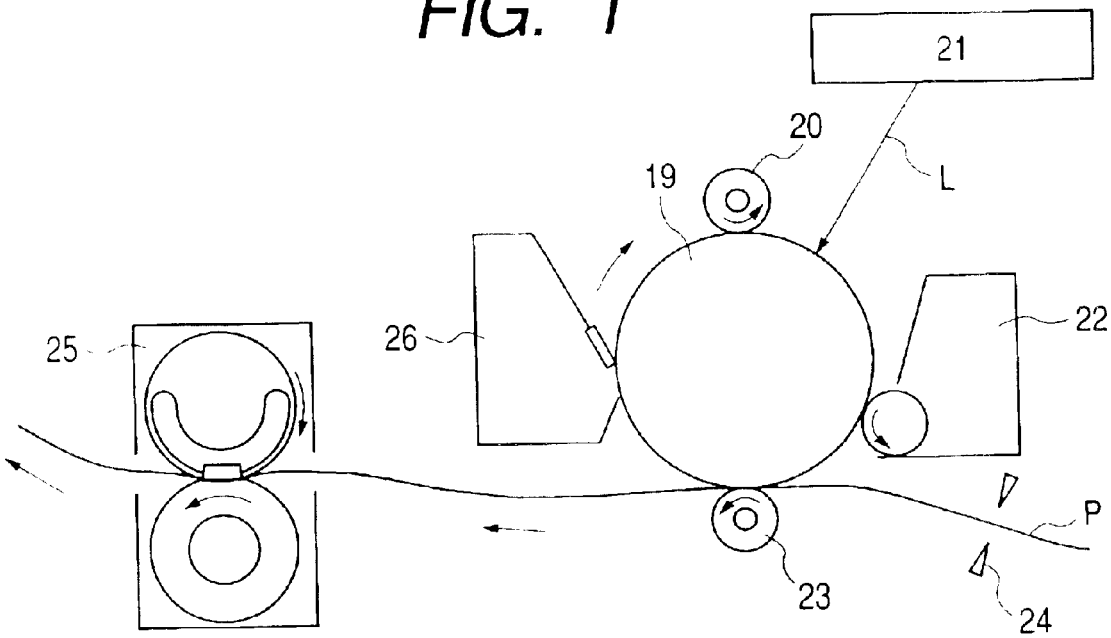
FIG. 1 is a schematic diagram showing the structure of an image forming apparatus according to the first embodiment.

FIG. 1 is a schematic diagram showing the structure of the image forming apparatus according to the present invention. Here, it should be noted that the image forming apparatus is a laser printer which uses an electrophotographic process.

Numeral 19 denotes a photosensitive drum which consists of a cylindrical basis of aluminum, nickel or the like on which a photosensitive material of OPC, amorphous Se, amorphous Si or the like is formed.

The photosensitive drum 19 is rotatively driven in the direction indicated by the arrow, and first the surface thereof is uniformly charged by a charging roller 20 which acts as a charging apparatus.

Next, laser beam scanning exposure L is performed on the uniformly charged surface of the rotating photosensitive drum 19 by a laser scanner unit 21, whereby an electrostatic latent image corresponding to image information is formed thereon. A laser beam which has been ON/OFF controlled according to the image information is reflected by a polygon mirror which is rotating in the laser scanner unit 21, whereby the laser beam scanning exposure L to the photosensitive drum 19 is performed.

The electrostatic latent image is then developed and thus visualized by a developing apparatus 22. Here, a jumping developing method, a two-component developing method, a FEED developing method or the like is used as a developing method, and, in the used developing method, a combination of image exposure and reversal developing is often used.

Then, by a transfer roller 23 which acts as a transfer apparatus, a toner image visualized is transferred from the photosensitive drum 19 to a recording material P which is conveyed from a not-shown sheet feeding mechanism portion at predetermined timing. Here, the leading edge of the recording material P is detected by a sensor 24 to adjust its timing so that the image forming position based on the toner image and the leading edge writing start position of the recording material P coincide with each other on the photosensitive drum 19. The recording material P conveyed at the predetermined timing is held tight and conveyed based on certain pressure force by the photosensitive drum 19 and the transfer roller 23. Here, it should be noted that, in the present embodiment, the recording material is conveyed according to center-based conveyance in the apparatus.

The recording material P on which the toner image has been transferred is conveyed to and fixed by a heating/fixing apparatus 25 as a permanent image.

On one hand, the residual toner on the photosensitive drum 19 is eliminated from the drum surface by a cleaning apparatus 26.

Moreover, a width sensor which operates when the recording material has a width wider than a predetermined width is provided on a conveyance path in front of the position where the image on the recording material is developed (i.e., on the recording material conveyance path in front of the nip formed between the photosensitive drum and the transfer roller), and the size of the recording material is discriminated based on a signal from the width sensor or a signal from a sensor provided on a not-shown sheet feeding cassette, whereby the control for the development and the fixing can be automatically changed.

(II) Heating/Fixing Apparatus 25

Figure 2:
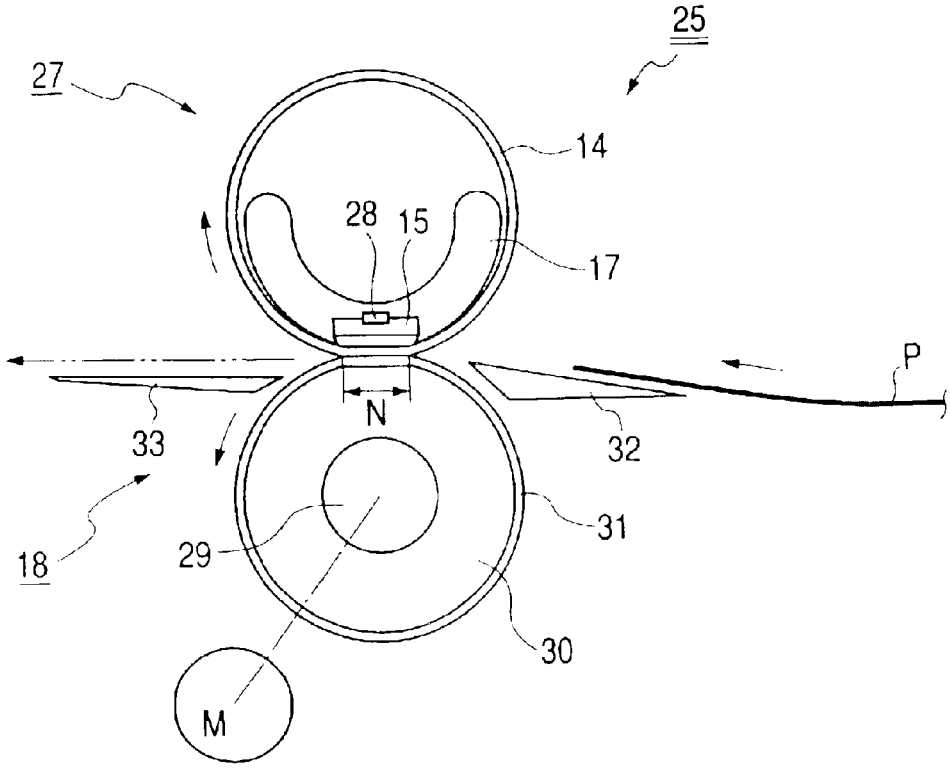
FIG. 2 is a schematic diagram showing the structure of a heating/fixing apparatus.

FIG. 2 is a schematic diagram showing the structure of the heating/fixing apparatus 25. The heating/fixing apparatus 25 according to the present embodiment is a heating apparatus of a film heating type and a pressing rotative member driving type (tensionless type) which uses a cylindrical (endless-belt-like) fixing film as a movement member, as shown in Japanese Patent Application Laid-Open Nos. 04-044075 to 04-044083, Japanese Patent Application Laid-Open Nos. 04-204980 to 04-204984, and the like.

1) Entire Structure of Apparatus 25

Numeral 27 denotes a fixing member (fixing unit), and numeral 18 denotes a pressure roller which acts as a pressure member. A fixing nip portion N is formed by bringing the fixing member 27 and the pressure roller 18 into tight contact with each other.

The fixing member 27 is the member of which the longitudinal edge is perpendicular to the face of this drawing. The fixing member 27 consists of a stay holder (support member) 17 which has the section of a substantial semi-arc gutter shape and has heat-resistivity and rigidity, a ceramic heater 15 which acts as the heating member and is fit and fixed into the concave groove portion disposed on the under surface of the stay holder 17 along its longitudinal edge, a cylindrical heat-resisting fixing film 14 of a small heat capacity which acts as the movement member and is externally fit loosely to the stay holder 17 equipped with the ceramic heater 15, and the like.

The pressure roller 18 is the rotative member which consists of a metal core 29 and an elastic layer 30. The elastic layer 30 is formed by foaming heat-resisting rubber such as silicone rubber, fluorine rubber or the like which is coaxially formed and provided with the metal core 29. Moreover, a heat-resisting mold release layer 31 which consists of fluorocarbon resin such as PFA, PTFE, FEP or the like may be formed on the elastic layer 30.

More specifically, the pressure roller 18 is composed of the elastic layer of silicone rubber or the sponge elastic layer 30 of foamed silicone rubber formed around the metal core 29, and the mold release layer 31 of PTFE, PFA, FEP or the like tubularly formed or coated around the elastic layer.

The pressure roller 18 is disposed so that the both ends of the metal core 29 are rotatably borne and held between the near and far side plates of the apparatus chassis (not shown).

Above the pressure roller 18, the fixing member 27 is disposed in parallel with this roller with the ceramic heater 15 side facedown, and both the ends of the stay holder 17 are biased toward the axis direction of the pressure roller 18 by a pressure means such as a not-shown spring or the like to bring the under surface of the ceramic heater 15 into pressure contact with the elastic layer 30 of the pressure roller 18 against the elastic force of this layer through fixing film 14 by predetermined pressure force, whereby the fixing nip portion N of a predetermined width necessary for the heating and fixing is formed. In the meantime, the pressure roller 30 side may be biased upward toward the under surface of the fixing member 27 by the pressure means to form the fixing nip portion N of the predetermined width.

The pressure roller 18 is rotatively driven counterclockwise as indicated by the arrow at predetermined rotational speed by a driving means M. Thus, the rotatory force affects the cylindrical fixing film 14 by the pressure contact frictional force at the fixing nip portion N between the outer surface of the pressure roller 18 and the fixing film 14 due to the rotational driving of the pressure roller 18, and the inner surface of the fixing film 14 slides on the under surface of the ceramic heater 15 in the situation that the film 14 and the heater 15 are in tight contact with each other. At the same time, the fixing film 14 is in the situation capable of being rotated clockwise as indicted by the arrow around the stay holder 17 according to the rotation of the pressure member 18.

When the pressure roller 18 is rotatively driven, the cylindrical fixing film 14 is thus rotated according to the rotation of the pressure roller 18. On one hand, the ceramic heater 15 is energized, whereby the temperature of this heater increases up to a predetermined temperature. In such a situation, the recording material P on which an unfixed toner image has been borne is guided and introduced into the fixing nip portion N between the fixing film 14 and the pressure roller 18 along a heat-resisting fixing access guide 32, and the recording material P is held tight and conveyed together with the fixing film 14 in the fixing nip portion N in the situation that the toner image bearing surface of the recording material P is in tightly contact with the outer surface of the fixing film 14. In this holding and conveying process, heat from the ceramic heater 15 is transferred to the recording material P through the fixing film 14, and the unfixed toner image on the recording material P is heated and thus pressed onto the recording material P, whereby the unfixed toner image is melted and fixed onto the recording material P. The recording material P which passed the fixing nip portion N is separated from the curved fixing film 14 and then guided and discharged to a not-shown sheet discharging tray by a heat-resisting fixing sheet discharging guide 33.

2) Heater 15

Figure 3A:
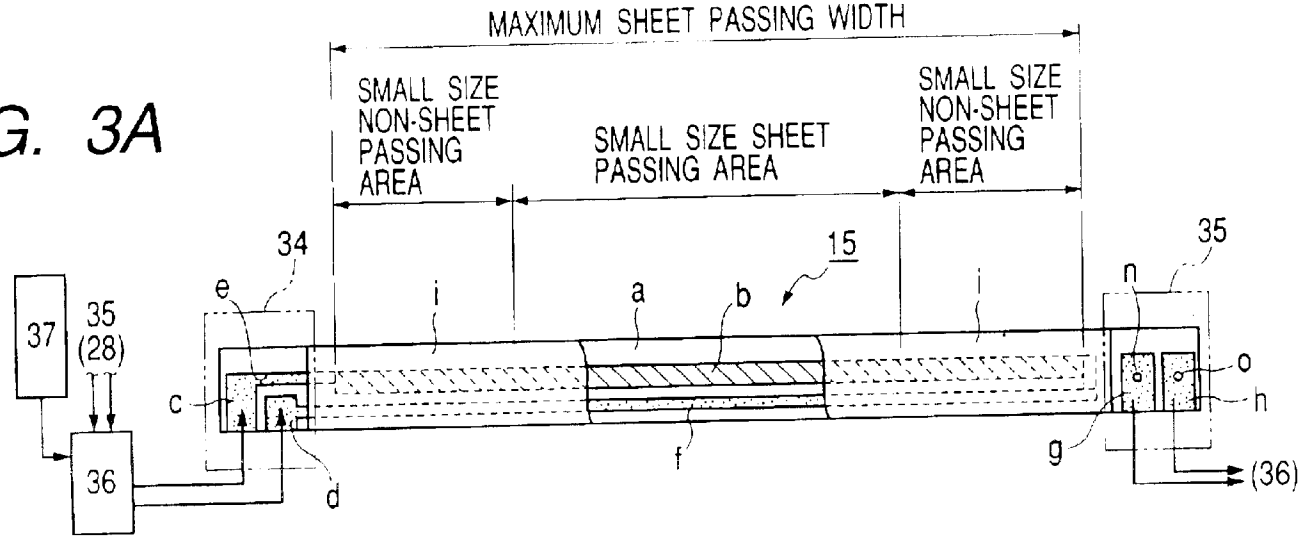
FIGS. 3A, 3B and 3C are each a model diagram showing the structure of a ceramic heater acting as a heating element.
Figure 3B:
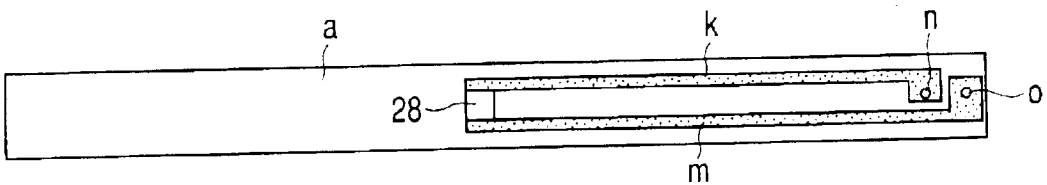
Figure 3C:
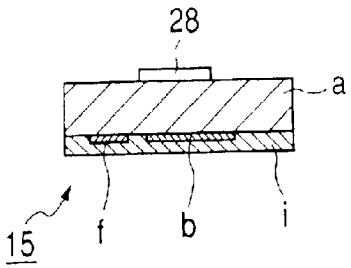

FIGS. 3A to 3C are each a model diagram showing the structure of the ceramic heater 15 which acts as the heating element in the present embodiment, and more specifically, the part (a) is the partial broken model diagram of the front side of the heater 15, the part (b) is the model diagram of the back side of the heater 15, and the part (c) is the enlarged cross sectional diagram of the heater 15.

The heater 15 consists of the components such as:

(1) an oblong heater substrate a, of which the longitudinal edge is perpendicular to the sheet passing direction and which is made by a heat-resisting, high insulative, excellent heat-conductive and low heat capacity member such as ceramic (e.g., alumina), polyimide, PPS, liquid crystal polymer or the like;

(2) a heat generating layer (energization heat generating resistive layer) b, of which the thickness is about 10 $\mu$m and the width is about 1 mm to 5 mm, which is coated like lines or stripes along the longitudinal edge on the front side of the heater substrate a by screen print or the like, and which is made of an electrical resistive material such as silver palladium (Ag/Pd), RuO2, Ta2N or the like for generating heat due to current flowing;

(3) first and second electrode portions c and d, extended cable run portions e and f, and third and fourth electrode portions g and h (used for later-described thermistor output), which are pattern-formed by screen print or the like of a silver paste on the front side of the heater substrate a as the feeding patterns for the heat generating layer b;

(4) a protective layer i such as a thin glass coat, a fluorocarbon resin layer or the like, of which the thickness is about 10 $\mu$m, which is formed on the heat generating layer b and the extended cable run portions e and f to protect them and secure insulation performance, and which can stand the sliding between the heater 15 and the fixing film 14; and (5) a thermistor 28 acting as a temperature detecting element and extended cable run portions k and m for thermistor output, which are provided on the back side of the heater substrate a.

Here, the terminals of the third and fourth electrode portions g and h for the thermistor output and the terminals of the extended cable run portions k and m for the thermistor output are electrically connected respectively via through holes n and o.

The heater 15 is fixed and supported by the stay holder 17 with the front side of the heater 15 exposed facedown.

A feeding connector 34 is mounted on the side of the first and second electrode portions c and d of the heater 15, and a temperature control circuit connector 35 is mounted on the side of the third and fourth electrode portions g and h.

By feeding electrical power from a heater driving circuit portion 36 to the first and second electrode portions c and d through the feeding connector 34, the heat generating layer b generates heat, whereby the temperature of the heater 15 rapidly increases (AC line).

The temperature of the heater 15 is detected by the thermistor 28, and the electrical information concerning the detected temperature is input to the heater driving circuit portion 36 through the third and fourth electrode portions g and h and the temperature control circuit connector 35 (DC line).

The heater driving circuit portion 36 appropriately controls a duty ratio, a frequency and the like in the voltage of the output power from a feeding circuit portion so that the detected temperature of the thermistor 28 is maintained to a predetermined set temperature (fixing temperature). By doing so, the surface temperature of the fixing film 14 is maintained to the fixable temperature in the fixing nip portion N. In other words, the heating necessary to maintain the controlled temperature in the fixing nip portion N to substantially a certain value and fix the toner image on the recording material is performed.

The heater 15 is the metal heater which is made by sequentially laminating the insulating layer and the energization heat generating resistive layer to the side, on the metal substrate, opposite to the fixing nip. The fixing nip side of the metal substrate may be curved. When AlN (aluminum nitride) or the like which is excellent in wear resistance and heat conductivity is used as the heater substrate a, the heat generating layer b may be formed on the side, on the substrate, opposite to the fixing nip portion.

3) Stay Holder 17

The stay holder 17 which is made by, e.g., a heat-resisting plastic material holds the heater 15 and also acts as the conveyance guide for the fixing film 14. Therefore, to improve the sliding property between the stay holder 17 and the fixing film 14, high heat-resisting grease or the like is put between the fixing film 14 and the heater 15 and also between the fixing film 14 and the outer surface of the stay holder 17.

More specifically, the stay holder 17 is the heat insulating material to hold the heater 15 and also prevent heat release from the heater 15 toward the direction opposite to the fixing nip portion N, and is made by liquid crystal polymer, phenolic resin, PPS, PEEK or the like. Moreover, the fixing film 14 is externally fit loosely to the stay holder 17, and the stay holder 17 is disposed to be able to rotate in the directed indicated by the arrow. Since the fixing film 14 rotates as sliding on the internal heater 15 and the stay holder 17, it is necessary to suppress the frictional resistance between the heater 15 and the fixing film 14 and between the stay holder 17 and the fixing film 14. For this reason, lubricant such as high heat-resisting grease or the like is put on the surfaces of the heater 15 and the stay holder 17, whereby the fixing film 14 can smoothly rotate.

4) Fixing Film 14

To minimize the heat capacity of the fixing film acting as the movement member so as to improve a quick-start property, the total thickness of this film may be set to 100 μm or less, preferably 60 μm or less. Moreover, to prevent the hot off-set and secure a separation property of the recording material, heat-resisting resin having an excellent mold release property such as fluorocarbon resin, e.g., PTFE (polytetrafluoroethylene), PFA (tetrafluoroethylene-perfluoroalkylvinylether copolymer), FEP (tetrafluoroethylene-hexafluoropropylene copolymer), ETFE (ethylene-tetrafluoroethylene copolymer), CTFE (polychlorotrifluoroethylene), PVDF (polyvinylidenefluoride) or the like, silicone resin or the like is coated mixedly or solely on the surface of the fixing film 14.

More specifically, the thickness of the fixing film 14 is considerably thinned to 20 μm to 70 μm so that heat of the heater 15 is effectively transferred to the recording material in the fixing nip portion N. The fixing film 14 is structured by three layers of a film base layer, a conductive primer layer and a mold release layer, and the film base layer is disposed on the heater side and the mold release layer is disposed on the pressure roller side. The film base layer is made by high insulative polyimide, polyamideimide, PEEK, SUS or the like which has high heat-resistivity, high resilience and flexibility and of which the thickness is about 15 μm to 60 μm. Moreover, the film base layer has mechanical strength such as tear strength or the like for the entire fixing film 14. The conductive primer layer is made by the thin layer of about 2 μm to 6 μm and is partially exposed on the surface of the fixing film 14. To prevent electrostatic off-set or the like, a not-shown conductive brush is in contact with the conductive primer layer exposed on the surface of the fixing film 14, and a bias of the same polarity as that of toner is applied while the print is being performed. The mold release layer is the toner off-set preventing layer to the fixing film 14, and is made by coating fluorocarbon resin such as PFA, PTFE, FEP or the like having an excellent mold release property by the thickness of about 5 μm to 15 μm. Moreover, to reduce charge-up on the surface of the fixing film 14 and prevent the electrostatic off-set, a conductive material such as carbon black or the like of which the resistivity is about 103 Ωcm to 106 Ωcm is mixed in the mold release layer.

(III) Countermeasure for Preventing Hot-offset

Figure 4:
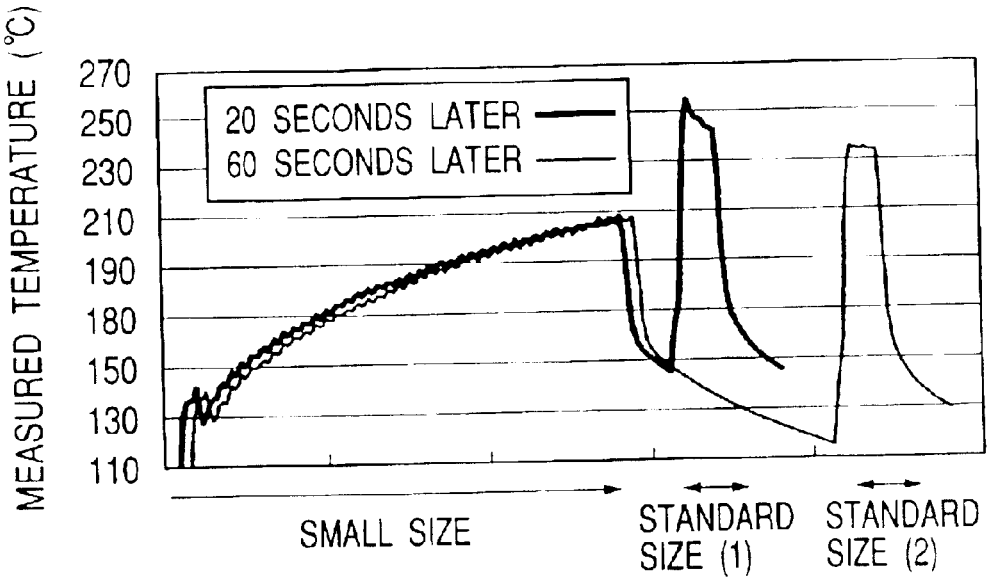
FIG. 4 is a diagram showing a temperature measured result in a small size non-sheet passing area.

In the image forming apparatus of such a structure as above, when the printing is performed on the standard size (large size) recording material after the printing was performed continuously on the small size recording materials at a controlled temperature 145° C., the temperature of the non-sheet passing area on the small size recording material is measured, and the measured result is shown in FIG. 4. Here, in the following explanation, "ordinary set temperature" indicates the set temperature when the fixing is performed on the standard size recording material.

Here, the horizontal axis of the graph shown in FIG. 4 indicates a time. The result of the temperature measurement in a case where the printing on the standard size sheet is performed 20 seconds after the printing on the small size sheets was continuously performed corresponds to the graph of "20 seconds later." Moreover, the result of the temperature measurement in a case where the printing on the standard size sheet is performed 60 seconds after the printing on the small size sheets was continuously performed corresponds to the graph of "60 seconds later." Besides, standard sizes (1) and (2) respectively indicate that the printing of the standard size sheet is performed 20 and 60 seconds after the end of the printing of the small size sheets.

When the small size recording material passes in the fixing nip, since the width of this recording material is sufficiently smaller than the width (length) of the heat generating layer b of the heater 15 and the heater is heated without absorbing its heat in the non-sheet passing area, the temperature of the non-sheet passing area increases in proportion as the number of the printings of the small size recording materials increases. As opposed to this, since the temperature of the sheet passing area is maintained constantly by the temperature detecting element, the temperature difference between the sheet passing area and the non-sheet passing area increases.

When the printing of the small size recording material ends, the temperature of the non-sheet passing area decreases with the lapse of time. Here, the standard size (1) of FIG. 4 indicates that the printing of the standard size recording material is performed at ordinary temperature 20 seconds after the end of the printing of the small size recording material. In this case, the time elapsed from the end of the printing of the small size recording material to the printing of the standard size recording material is short and thus the printing of the standard size recording material is performed before the temperature of the non-sheet passing area decreases, whereby the temperature in the non-sheet passing area on the small size recording material increases up to 250° C. or more, and thus the heavy hot off-set occurs.

On the contrary, the standard size (2) of FIG. 4 indicates that the printing of the standard size recording material is performed at ordinary temperature 60 seconds after the end of the printing of the small size recording material. In this case, the time elapsed from the end of the printing of the small size recording material to the printing of the standard size recording material is comparatively long and thus the printing of the standard size recording material is performed in the situation that the temperature of the non-sheet passing area has decreased to some extent, whereby the temperature in the non-sheet passing area on the small size recording material increases up to up to the extent slightly exceeding 230° C. Although the hot off-set somewhat occurs even in this case, the situation has improved greatly as compared with the case where the printing of the standard size recording material is performed 20 seconds after the end of the printing of the small size recording material.

Figure 5:
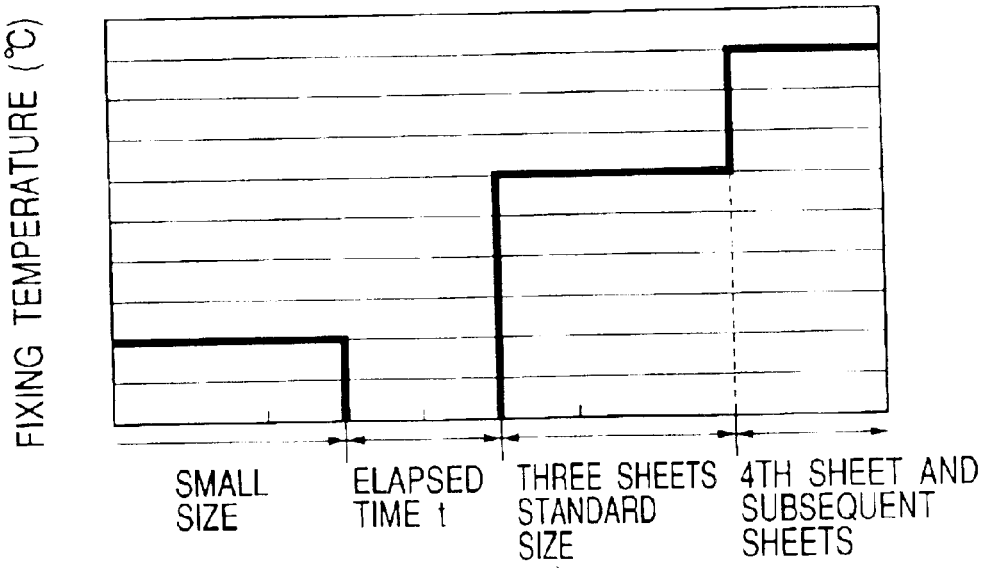
FIG. 5 is a diagram showing a fixing setting temperature in the first embodiment.

Therefore, in the present embodiment, as shown in FIG. 5, the temperature to be controlled when the standard size recording material is passed after elapsing a predetermined time from the printing of the small size recording material is set to be lower than the ordinary fixing temperature. Moreover, as shown in Table 1, the temperature setting at this time is determined based on the number of the printings of the small size recording materials and a time t elapsed from the printing of the small size recording material to the printing of the standard size recording material.

TABLE 1

| | The Number of Printings of Small Size Recording Materials | | | |
|---|---|---|---|---|
| | 1–10 | 11–30 | 31–50 | 51– |
| 0–30 sec. | −10° C. | −20° C. | −30° C. | −40° C. |
| 31–60 sec. | — | −10° C. | −20° C. | −30° C. |
| 61–90 sec. | — | — | −10° C. | −20° C. |
| 91–120 sec. | — | — | — | −10° C. |

As shown in FIG. 5, according to the present embodiment, the printing is performed to the three sheets at the fixing temperature set on Table 1, and the printing is performed to the fourth and subsequent sheets at the ordinary fixing temperature, thereby preventing deterioration of fixability.

The setting of the fixing temperature is controlled by the heater driving circuit portion 36 (FIG. 3A). That is, the width information (size information) representing the width of the passed and used recording material, the small size print number information representing the number of the printings of the small size recording materials, and the time information representing the time from the end of the printing of the small size recording material to the printing of the standard size recording material are input from an engine controller 37 in the image forming apparatus to the heater driving circuit portion 36. The fixing temperature setting table as shown in Table 1 has been stored as the reference data in the heater driving circuit portion 36. Thus, the heater driving circuit portion 36 changes the fixing setting temperature according to the fixing temperature setting table of Table 1 based on the above information input from the engine controller 37, and thus controls the temperature of the fixing apparatus based on the changed temperature.

Here, it should be noted that "ordinary temperature" or "ordinary fixing temperature" in the above explanation indicates the fixing temperature of plain paper (sheet). Moreover, in FIG. 5, the fixing temperature increases in proportion as the value of the scale on the vertical axis increases. The fixing temperature of the small size recording material is 145° C., and this temperature 145° C. is different from the fixing temperature of the standard size recording material being the plain paper fixing temperature.

Figure 6:
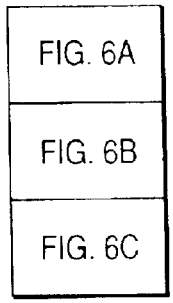
FIG. 6, which is comprised of FIGS. 6A, 6B and 6C, is a flow chart showing a fixing temperature setting operation to be executed by a heater driving circuit portion in the first embodiment.
Figure 6A:
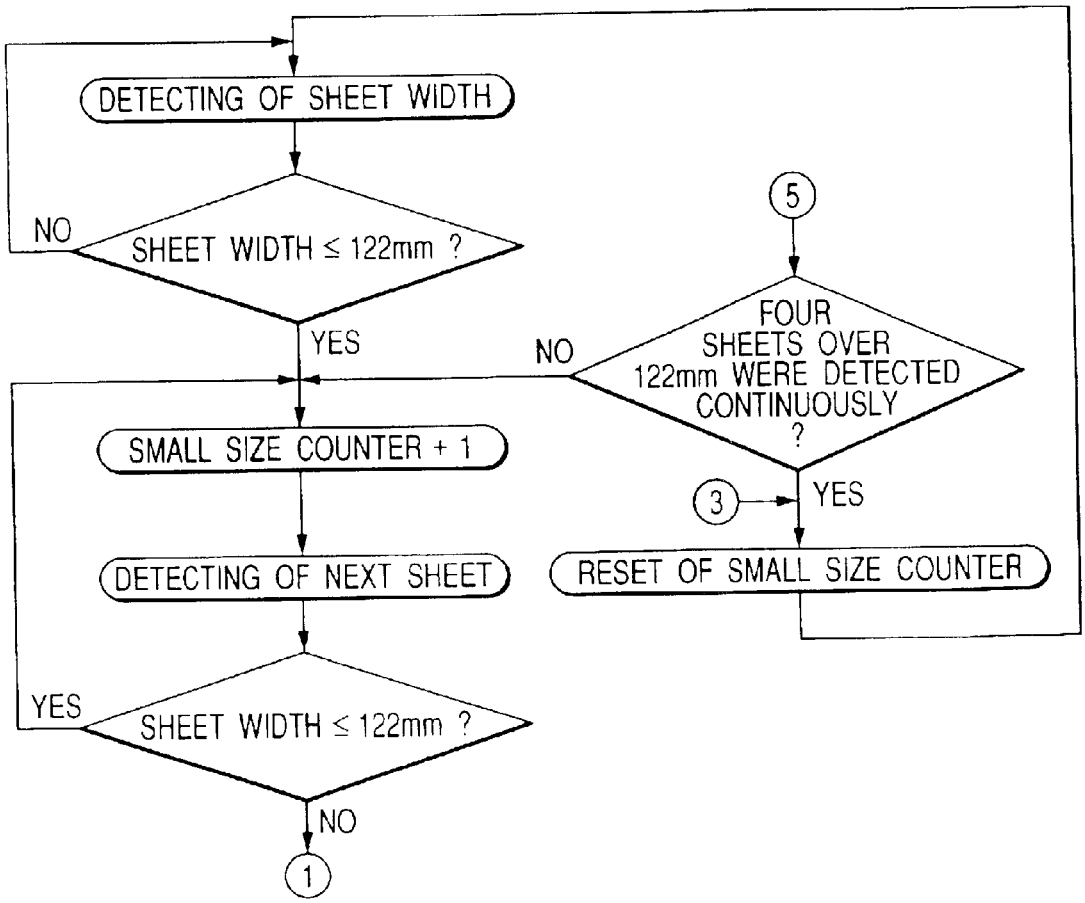
Figure 6B:
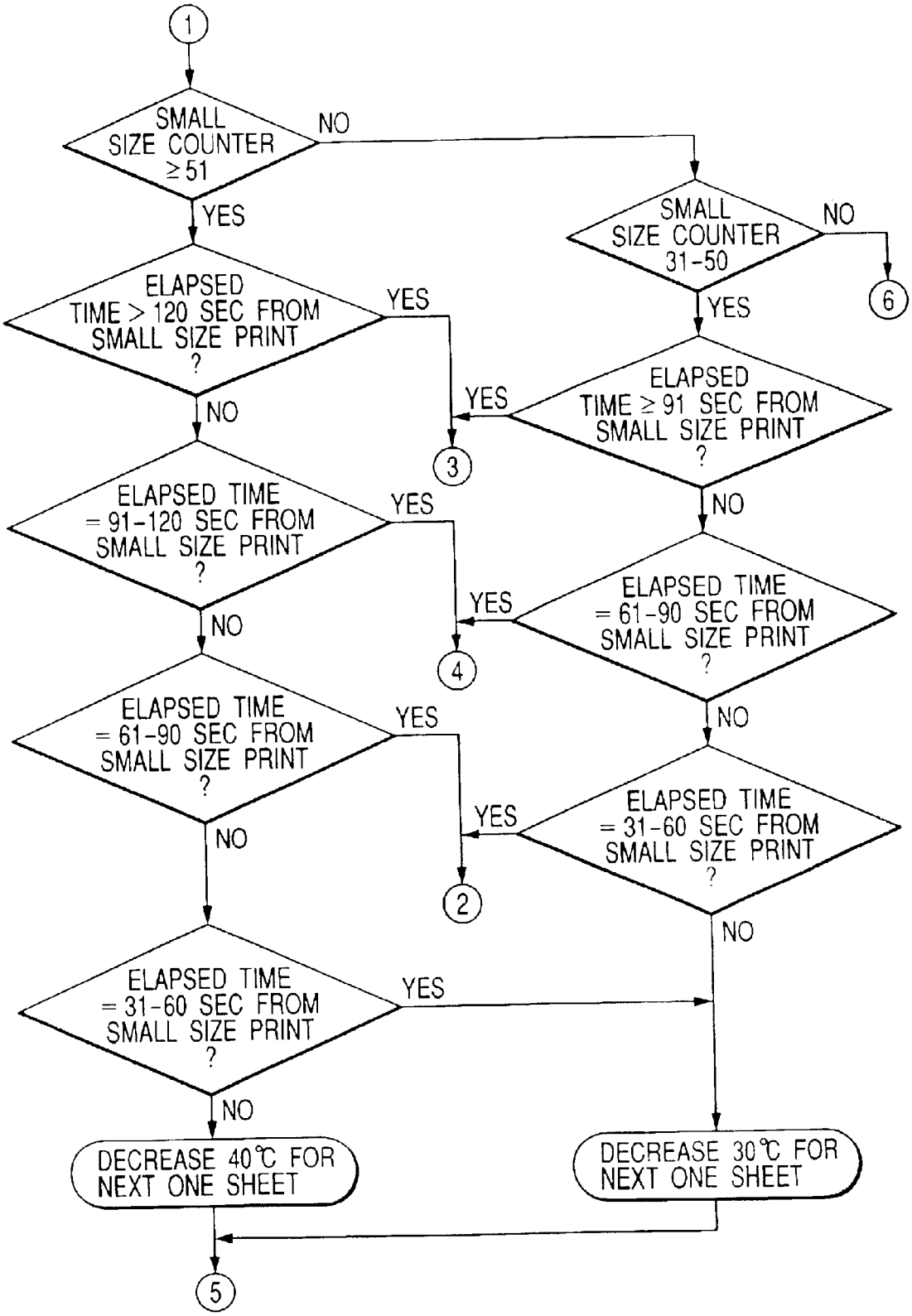
Figure 6C:
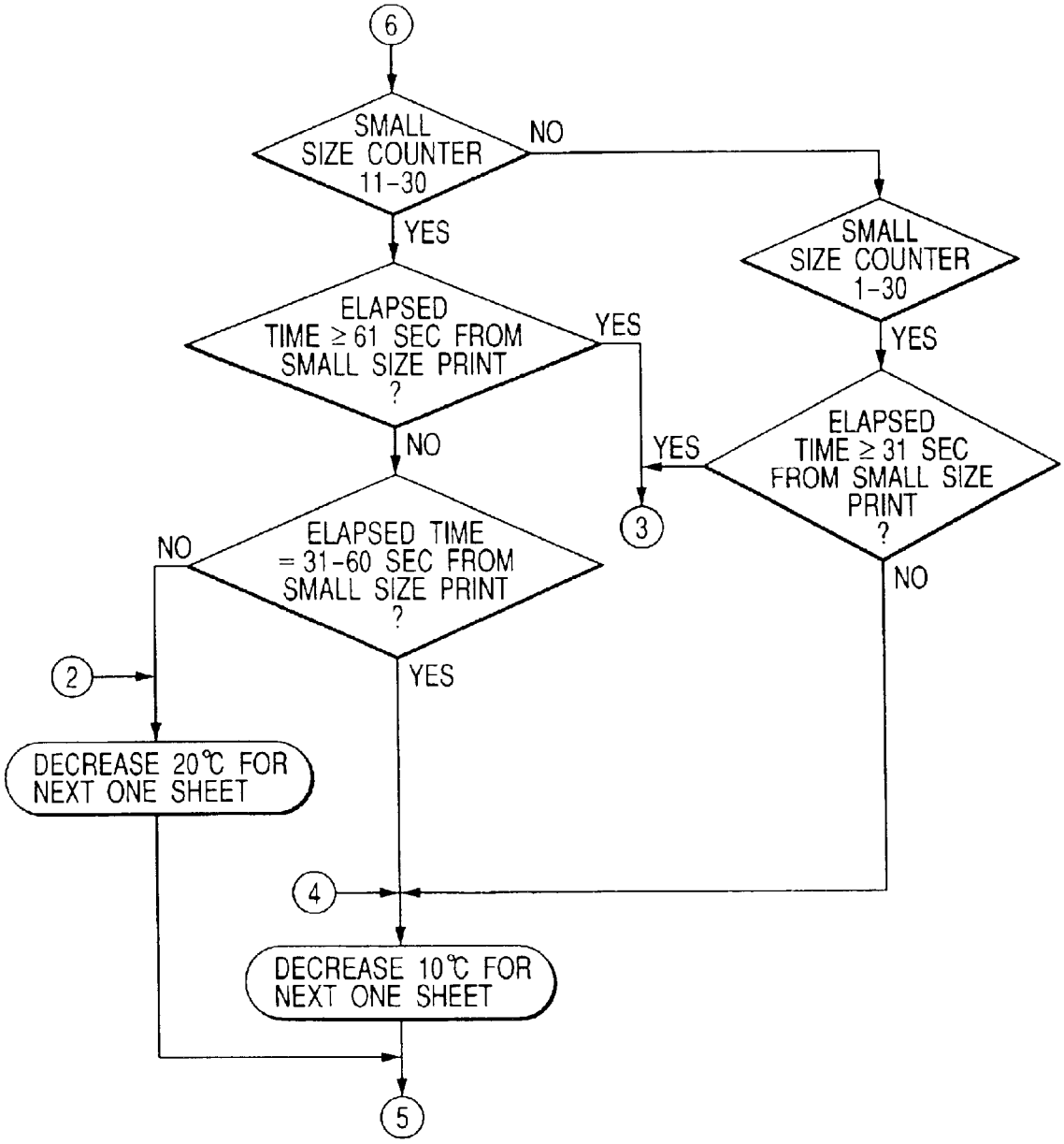

FIG. 6, which is comprised of FIGS. 6A to 6C, is a flow chart showing "fixing temperature setting operation" to-be executed by the heater driving circuit portion 37 in the present embodiment.

Under the above control, the printing to an LTR size sheet is performed respectively 30 seconds, 60 seconds, 90 seconds and 120 seconds after the printing to 60 envelopes of com#10 size was performed, and the fixability and the hot off-set are evaluated in this case.

Figure 7:
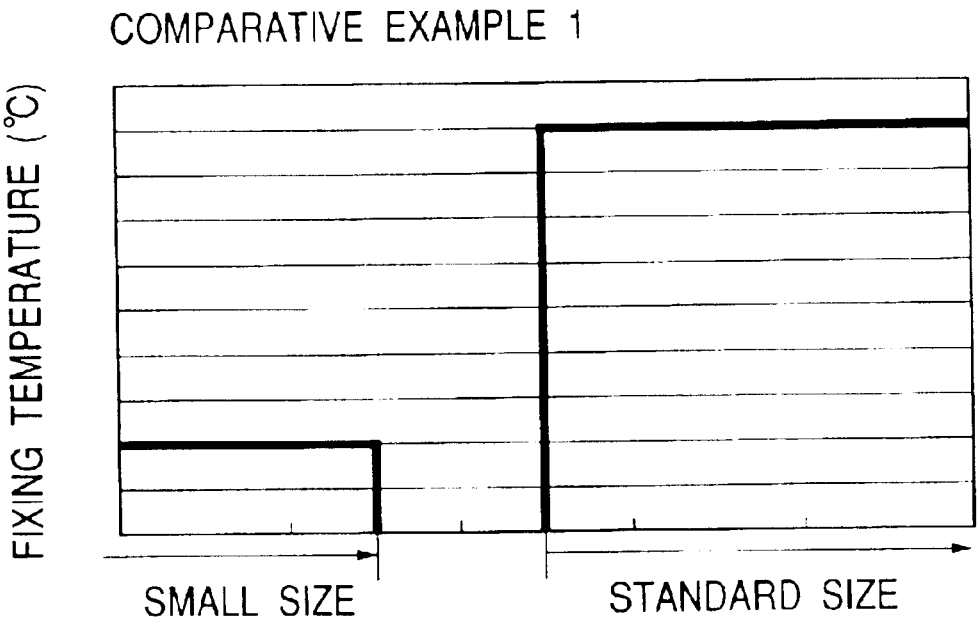
FIG. 7 is a diagram showing a fixing setting temperature in the comparative example 1.

As a comparative example 1, the fixability and the hot off-set in the case where the printing is performed at the ordinary fixing temperature in the printing of the standard size recording material after the printing of the small size recording material are evaluated as shown in FIG. 7. Moreover, as a comparative example 2, the fixability and the hot off-set in the case where the fixing temperature of the standard size recording material is determined only based on the number of the printings of the small size recording materials are evaluated as shown in Table 2.

The temperature in the area of the standard size in FIG. 7 is "ordinary set temperature," and FIG. 7 indicates that the temperature is not set to be lower than the ordinary set temperature in the case where the printing of the standard size recording material is performed after the passing of the small size recording material.

TABLE 2

| Temperature Control in Comparative Example 2 The Number of Printings of Small Size Recording Materials | | | |
|---|---|---|---|
| 1–10 | 11–30 | 31–50 | 51– |
| −10° C. | −20° C. | −30° C. | −40° C. |

The evaluation of the fixability is performed in regard to bond paper on which poor fixing easily occurs, and the evaluation of the hot off-set is performed in regard to thin paper on which the hot off-set easily occurs.

The results of the evaluation will be shown in Table 3 and Table 4. Here, it should be noted that, in Table 3 and Table 4, "PE" is the abbreviation of "present embodiment," "CE1" is the abbreviation of "comparative example 1," "CE2" is the abbreviation of "comparative example 2," "SPA" is the abbreviation of "sheet passing area," and "NSPA" is the abbreviation of "non-sheet passing area."

TABLE 3

Hot Off-Set Evaluation Results

| | PE | | CE1 | | CE2 | |
|---|---|---|---|---|---|---|
| | SPA | NSPA | SPA | NSPA | SPA | NSPA |
| 30 sec. later | ○ | ○ | ○ | XX | ○ | ○ |
| 60 sec. later | ○ | ○ | ○ | X | ○ | ○ |
| 90 sec. later | ○ | ○ | ○ | X | ○ | ○ |
| 120 sec. later | ○ | ○ | ○ | Δ | ○ | ○ |

○: good,
Δ: fair,
X: poor

TABLE 4

Fixability Evaluation Results

| | PE | | CE1 | | CE2 | |
|---|---|---|---|---|---|---|
| | SPA | NSPA | SPA | NSPA | SPA | NSPA |
| 30 sec. later | ○ | ○ | ○ | ○ | ○ | ○ |
| 60 sec. later | ○ | ○ | ○ | ○ | Δ | ○ |
| 90 sec. later | ○ | ○ | ○ | ○ | Δ | ○ |
| 120 sec. later | ○ | ○ | ○ | ○ | X | ○ |

○: good,
Δ: fair,
X: poor

As above, in the comparative example 1, since the fixing temperature in the printing of the standard size recording material after the printing of the small size recording material is set in the usual manner, the in-nip temperature in the non-sheet passing area on the small size recording material excessively increases, whereby the hot off-set occurs.

Although the hot off-set is improved in proportion as the time from the end of the printing of the small size recording material to the beginning of the recording of the standard size recording material is prolonged, it somewhat occurs even if this time is 120 seconds later.

In the comparative example 2, the temperature setting at the time of 30 seconds later is the same as that in the present embodiment, whereby the excellent image in which there is no problem in regard to both the hot off-set and the fixability can be obtained. However, when the elapsed time from the printing of the small size recording material is prolonged, the poor fixing occurs in the sheet passing area on the small size recording material because the fixing temperature of the standard size recording material has been set to be lower than the ordinary fixing temperature by 40° C., as well as the case where the elapsed time is short, although the temperature in the nip has become low.

On the contrary, according to the present embodiment, the fixing temperature in the printing of the standard size recording material is determined according to the elapsed time from the end of the printing of the small size recording material to the end of the printing of the standard size recording material, whereby the excellent image in which there is no problem in regard to both the hot off-set and the fixability can be obtained.

As above, in the case where the printing of the standard size recording material is performed after the printing of the small size recording material was performed, the fixing temperature is set to be lower than the ordinary set temperature. In this case, the set temperature is controlled so as to become low in proportion as the number of the printings of the small size recording materials becomes large and also controlled so as to become low in proportion as the time from the end of the printing of the small size recording material to the printing of the standard size recording material becomes short, whereby the excellent image in which the hot off-set and the poor fixing do not occur can be obtained. Moreover, by suppressing the temperature increase in the non-sheet passing portion, a margin for a slip of the recording material can be enlarged.

<Second Embodiment>

In the present embodiment, the entire structures of an image forming apparatus and a heating/fixing apparatus are the same as those in the first embodiment, whereby redundant explanations of these structures will be omitted.

Also in the present embodiment, a fixing temperature is set to be lower than an ordinary fixing temperature in a case where printing of a standard size recording material is performed after printing of a small size recording material was performed. Moreover, the present embodiment is characterized in that the fixing temperature is gradually approximated to the ordinary fixing temperature every time one standard size recording material is passed. Although a temperature of a non-sheet passing portion increases due to the printing of the small size recording material, heat generated in the non-sheet passing portion corresponding to the small size is absorbed by the standard size recording material when the standard size recording material is passed, whereby the temperature of the non-sheet passing portion corresponding to the small size decreases. For this reason, hot off-set comes not to occur if the printing of the standard size recording materials of several numbers is performed.

Figure 8:
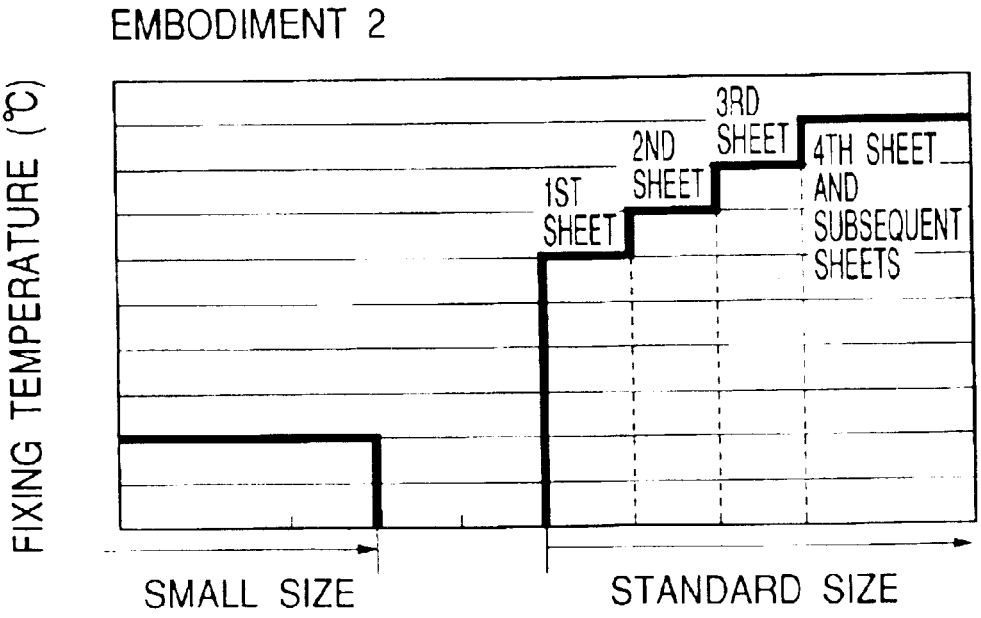
FIG. 8 is a diagram showing a fixing setting temperature in the second embodiment.

Here, in FIG. 8, the fixing temperature of "fourth sheet and subsequent sheets" is the ordinary fixing temperature which is different from a controlled temperature 145° C. The fixing temperature of the small size recording material is essentially different from that of the standard size recording material, that is, the fixing temperature of the standard size recording material is set to be higher than that of the small size recording material.

Therefore, in the present embodiment, the fixing temperature in the case where the printing of the standard size recording material (or sheet) is performed after the printing of the small size recording material was performed is set as shown in Tables 5 to 8 below.

TABLE 5

| | The Number of Printings of Small Size Sheets 1–10 Sheets | | | |
|---|---|---|---|---|
| | 1st Sheet | 2nd Sheet | 3rd Sheet | 4th Sheet |
| 0–30 sec. | −10° C. | — | — | — |
| 31–60 sec. | — | — | — | — |
| 61–90 sec. | — | — | — | — |
| 91–120 sec. | — | — | — | — |

TABLE 6

| | The Number of Printings of Small Size Sheets 11–30 Sheets | | | |
|---|---|---|---|---|
| | 1st Sheet | 2nd Sheet | 3rd Sheet | 4th Sheet |
| 0–30 sec. | −20° C. | −10° C. | — | — |
| 31–60 sec. | −10° C. | — | — | — |
| 61–90 sec. | — | — | — | — |
| 91–120 sec. | — | — | — | — |

TABLE 7

| | The number of Printings of Small Size Sheets 31–50 Sheets | | | |
|---|---|---|---|---|
| | 1st Sheet | 2nd Sheet | 3rd Sheet | 4th Sheet |
| 0–30 sec. | −30° C. | −20° C. | −10° C. | — |
| 31–60 sec. | −20° C. | −10° C. | — | — |
| 61–90 sec. | −10° C. | — | — | — |
| 91–120 sec. | — | — | — | — |

TABLE 8

| | The number of Printings of Small Size Sheets 51 or more Sheets | | | |
|---|---|---|---|---|
| | 1st Sheet | 2nd Sheet | 3rd Sheet | 4th Sheet |
| 0–30 sec. | −40° C. | −30° C. | −20° C. | −10° C. |
| 31–60 sec. | −30° C. | −20° C. | −10° C. | — |
| 61–90 sec. | −20° C. | −10° C. | — | — |
| 91–120 sec. | −10° C. | — | — | — |

Figure 9:
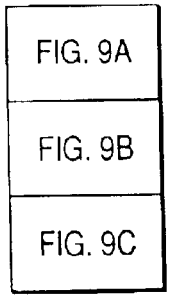
FIG. 9, which is comprised of FIGS. 9A, 9B and 9C, is a flow chart showing a fixing temperature setting operation to be executed by a heater driving circuit portion in the second embodiment.
Figure 9A:
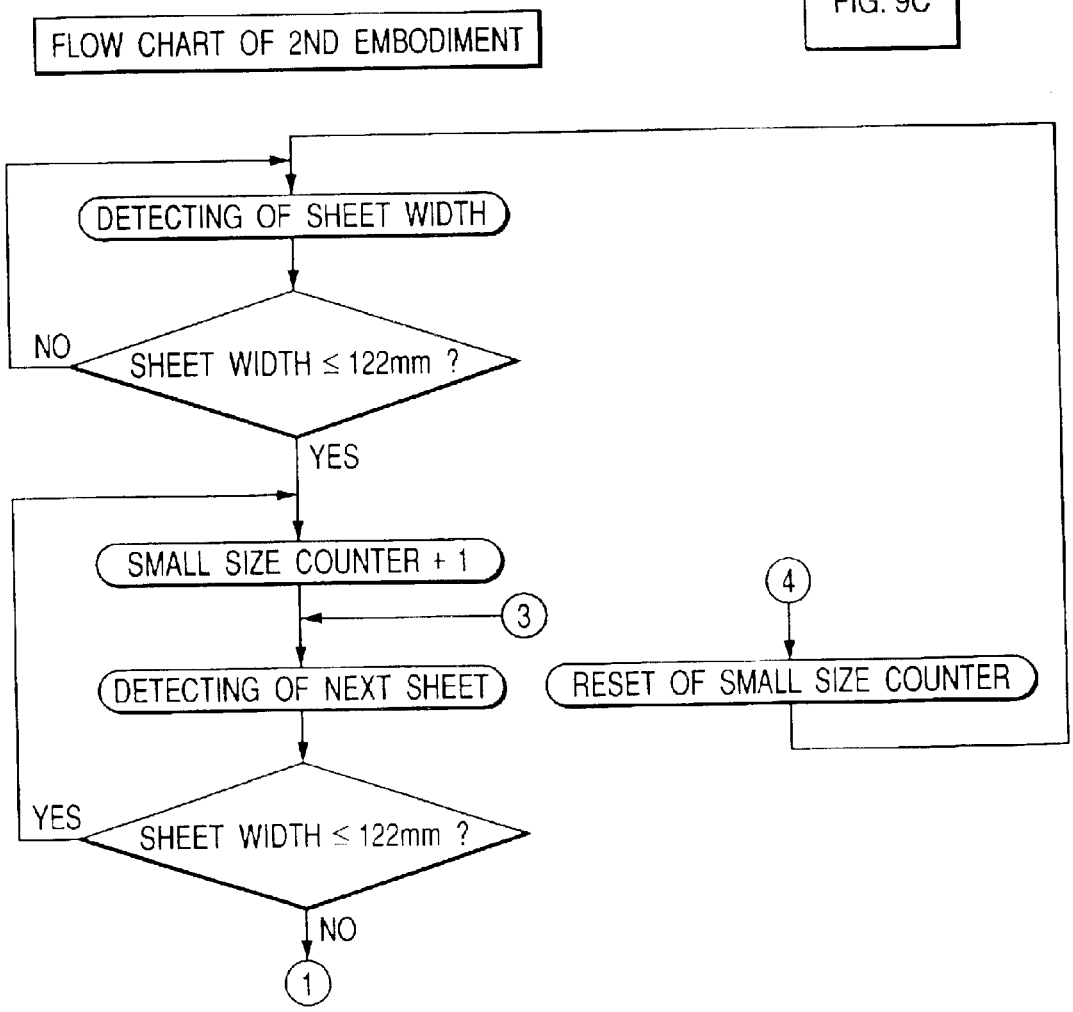
Figure 9C:
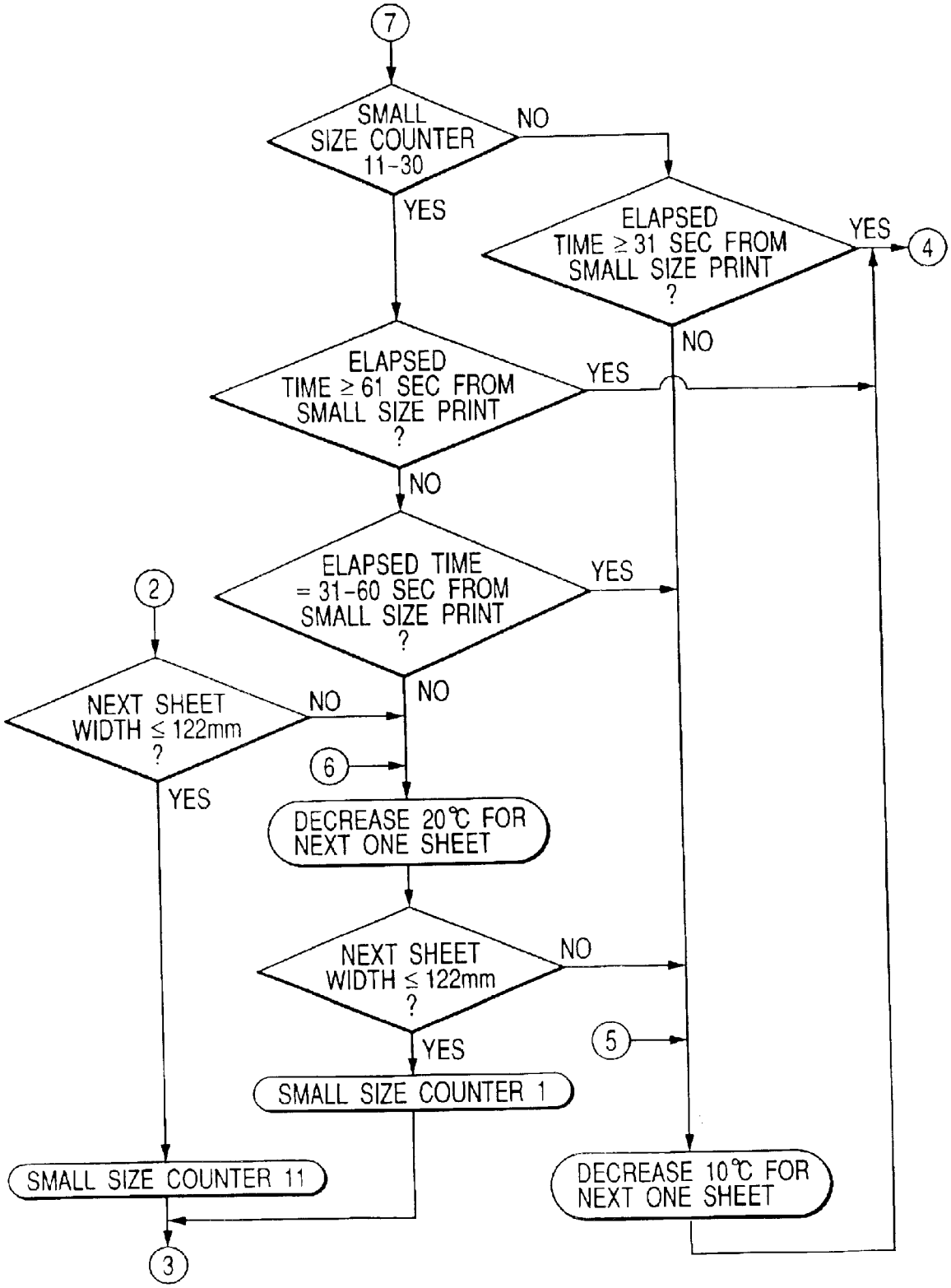

FIG. 9, which is comprised of FIGS. 9A to 9C, is a flow chart showing "fixing temperature setting operation" to be executed by a heater driving circuit portion 37 in the present embodiment.

Under the above control, the printing to an LTR size recording material is performed after the printing to 60 envelopes of com#10 size was performed. Since the fixing temperature of the first sheet is the same as that in the first embodiment, whereby an excellent image in which the hot off-set can be prevented and sufficient fixability is secured can be obtained. Moreover, although the fixing temperature of the second and subsequent sheets is increased by 10° C. whenever the printing of ten sheets is performed until the fixing temperature becomes the ordinary fixing temperature, any hot off-set does not occur, and the fixability can be improved as compared with the first embodiment.

<Others>

1) The structure of the ceramic heater 15 acting as the heating element is not of course limited to the structure described in the embodiments.

Figure 10:
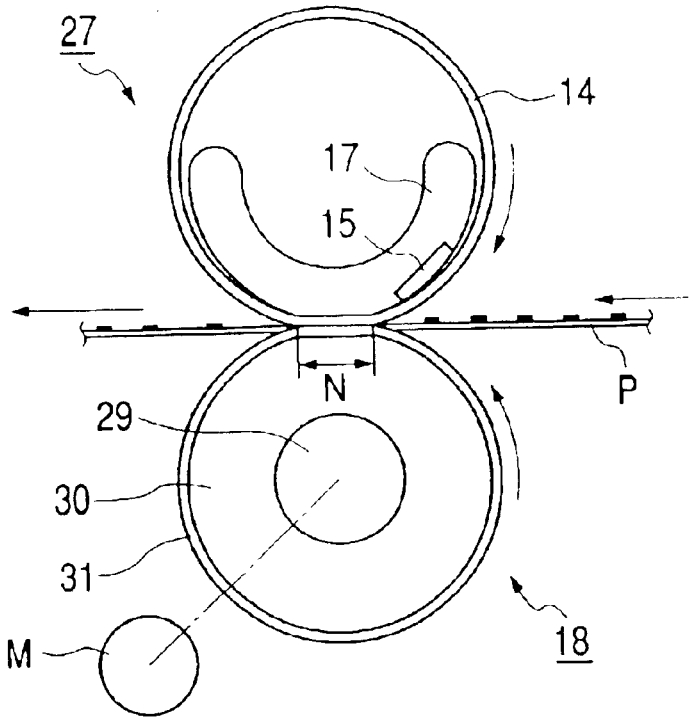
FIG. 10 is a model diagram showing a heating/fixing apparatus of another structure.

Moreover, the heater 15 may not necessarily be located in the fixing nip portion N. For example, as shown in FIG. 10, it is possible to locate and dispose the heater 15 on the upstream side of the fixing nip portion N in the film movement direction.

Figure 11:
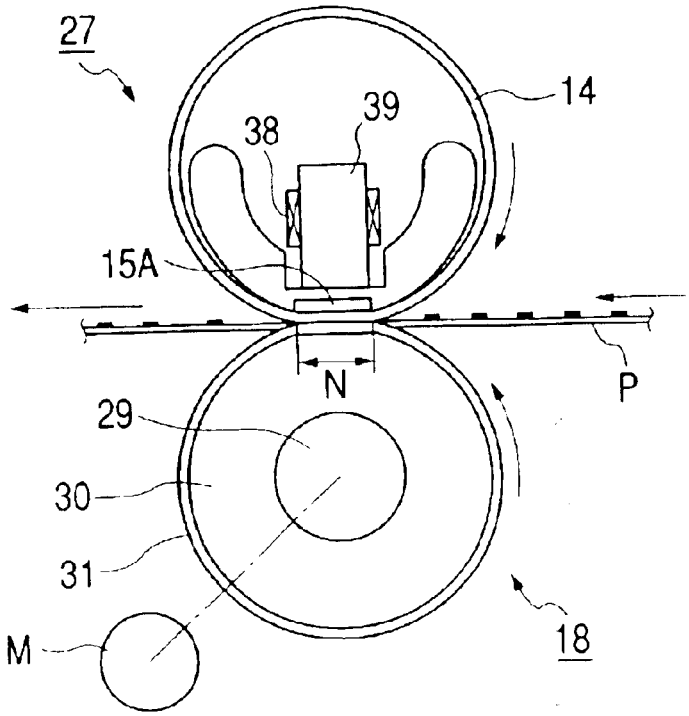
FIG. 11 is a model diagram showing a heating/fixing apparatus of further another structure.
Figure 12:
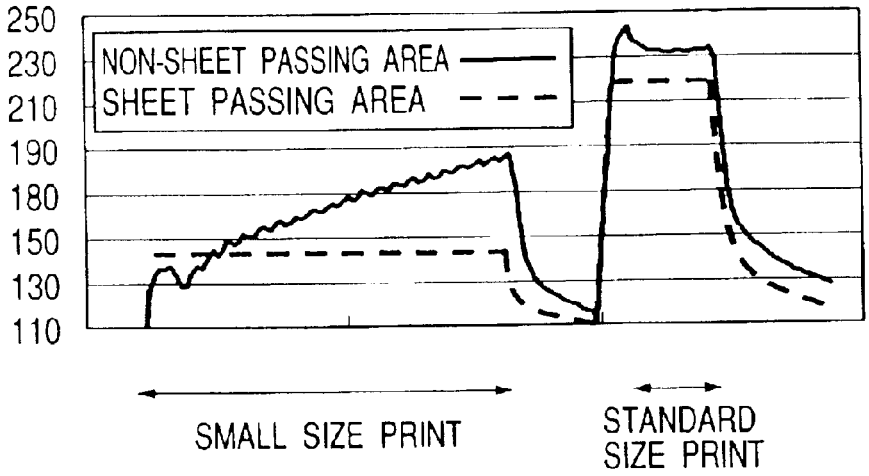
FIG. 12 is a diagram showing a temperature measured result in a small size non-sheet passing area in the related background art.
Figure 13:
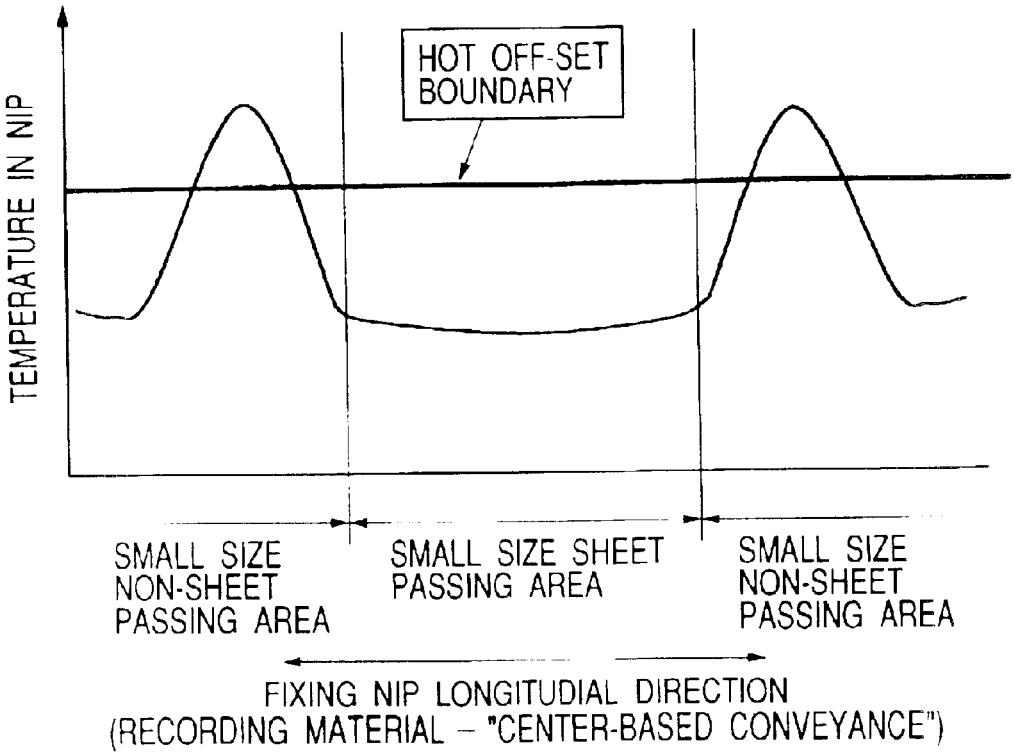
FIG. 13 is a schematic diagram showing a temperature distribution in an in-heater longitudinal direction in the related background art.
Figure 14:
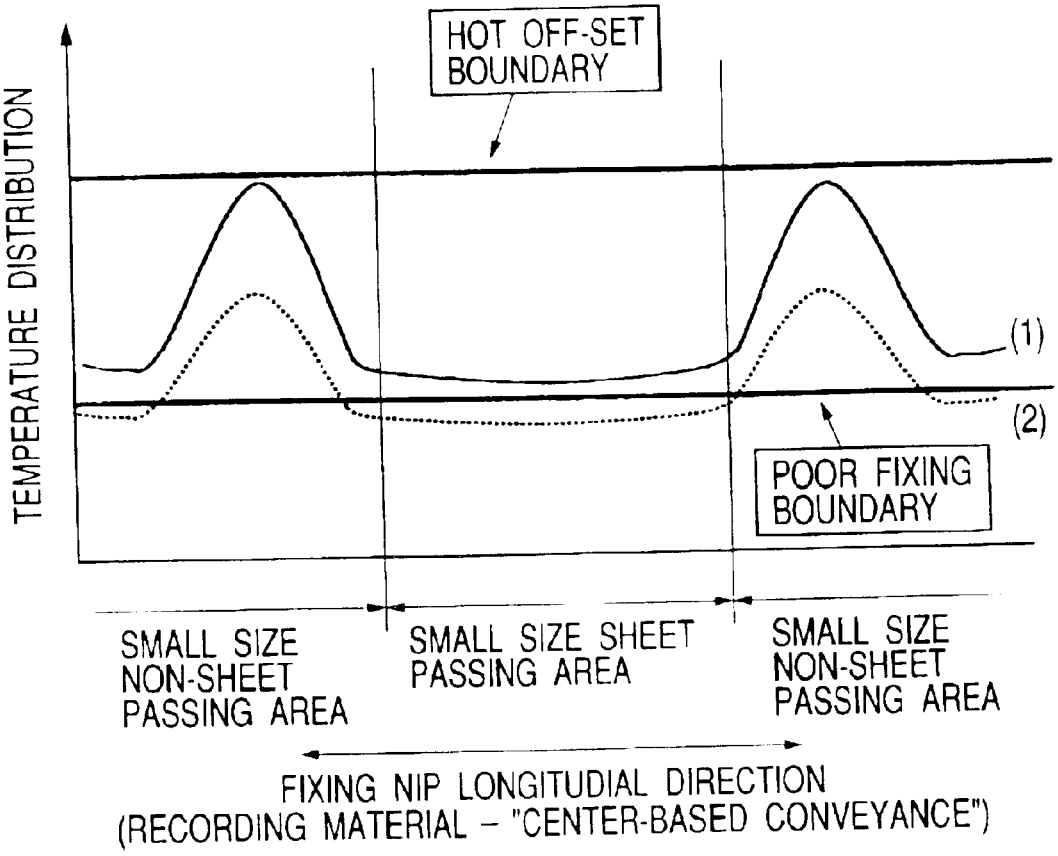
FIG. 14 is a schematic diagram showing a temperature distribution in the in-heater longitudinal direction in the related background art.

2) The heater 15 is not limited to the ceramic heater. For example, the heater 15 may be an electromagnetic induction heat generating member such as an iron plate or the like. FIG. 11 shows an adoptable apparatus structure that an electromagnetic induction heat generating member 15A such as the iron plate or the like used as the heater is disposed at the position of the fixing nip portion N, and a high-frequency magnetic field generated by an electromagnetic coil 38 and a magnetic core 39 functioning as an alternating magnetic filed generating means is acted on the disposed member to generate heat. Even in this case, the electromagnetic induction heat generating member 15A acting as the heater may not necessarily be located in the fixing nip portion N.

Moreover, the film 15 itself acting as the movement member may be made by the electromagnetic induction heat generating member to generate heat by using the alternating magnetic filed generating means.

3) The heating/fixing apparatus of the film heating system in the embodiments adopts the pressing rotative member driving system. However, the heating/fixing apparatus may be an apparatus which adopts a system that causes a driving roller provided on the inner surface of an endless fixing film to drive the film as applying tension, or an apparatus which adopts a system that drives and runs the film formed like a rolled web having an end.

4) In the present invention, the image heating apparatus is not limited to the type adopting the film heating system, but may be an image heating apparatus of a type for heating an image on a recording material by holding tight and conveying the recording material bearing the image at a nip formed between a heating member and a pressure member.

5) The image heating apparatus according to the present invention includes not only the fixing apparatus which heats and fixes the unfixed image onto the recording material as the permanent image but also a heating apparatus which modifies an image surface property such as gloss or the like by reheating the recording material bearing an image, or the like.

6) The image forming system of the image forming apparatus is not limited to the electrophotographic system, but may be an electrostatic recording system, a magnetic recording system or the like, and moreover may be a transferring system or a direct system.

What is claimed is:

1. An image heating apparatus which heats an image borne on a recording material by holding tight and conveying the recording material bearing the image at a nip formed between a heating member having a heating element and a pressure member, comprising:

a temperature detecting element for detecting a temperature in the vicinity of said heating member; and a control unit for controlling power supply to said heating element so that the temperature in the vicinity of said heating member becomes a target temperature, on the basis of an output from said temperature detecting element, wherein, in a case where, after the recording material of a first width was passed, the recording material of a second width wider than said first width is passed, said control unit sets the target temperature at the time when the recording material of said second width is passed, according to the number of the passed recording materials of said first width and an elapsed time after the recording material of said first width was passed.

2. An image heating apparatus according to claim 1, wherein said heating member includes a flexible movement member and a support member which has a slide surface sliding on said movement member and supports said movement member, and said heating member heats the image borne on the recording material by slidingly moving said movement member on the surface of said support member at the nip and then holding tight and conveying the recording material bearing the image between said movement member and said pressure member at the nip.

3. An image heating apparatus according to claim 1, wherein, in the case where the recording material of said second width wider than said first width is passed after the recording material of said first width was passed, said control unit performs the control so that the target temperature at the time when the recording material of said second width is passed becomes low in proportion as the number of the passed recording materials of said first width becomes large and a time from the end of the passing of the recording material of said first width to the beginning of the passing of the recording material of said second width becomes short.

4. An image heating apparatus according to claim 2, wherein said heating element is disposed in the vicinity of a nip portion of said support member, and the image borne on the recording material is heated by said heating element through said movement member.

5. An image heating apparatus according to claim 3, wherein, in the case where the recording material of said second width is passed after the recording material of said first width was passed, said control unit increase the target temperature stepwise according to the number of the passed recording materials of said second width.

6. An image heating apparatus according to claim 1, wherein, in a case where, after elapsing a predetermined time or more from the passing of the recording material of said first width, the recording material of said second width is passed, said control unit sets a certain target temperature irrespective of the elapsed time and the number of the passed recording materials of said first width, and also makes the predetermined time different according to the number of the passed recording materials of said first width.

7. A temperature controlling method in an image heating apparatus which heats an image borne on a recording material by holding tight and conveying the recording material bearing the image at a nip formed between a heating member having a heating element and a pressure member, said method comprising:

a step of detecting a temperature in the vicinity of the heating member by using a temperature detecting element; and a step of controlling power supply to the heating element so that the temperature in the vicinity of the heating member becomes a target temperature, on the basis of an output from the temperature detecting element, wherein, in a case where, after the recording material of a first width was passed, the recording material of a second width wider than the first width is passed, said controlling step sets the target temperature at the time when the recording material of the second width is passed, according to the number of the passed recording materials of the first width and an elapsed time after the recording material of the first width was passed.

8. A temperature controlling method according to claim 7, wherein the heating member includes a flexible movement member and a support member which has a slide surface sliding on the movement member and supports the movement member, and the heating member heats the image borne on the recording material by slidingly moving the movement member on the surface of the support member at the nip and then holding tight and conveying the recording material bearing the image between the movement member and the pressure member at the nip.

9. A temperature controlling method according to claim 7, wherein, in the case where the recording material of the second width wider than the first width is passed after the recording material of the first width was passed, said controlling step performs the control so that the target temperature at the time when the recording material of the second width is passed becomes low in proportion as the number of the passed recording materials of the first width becomes large and a time from the end of the passing of the recording material of the first width to the beginning of the passing of the recording material of the second width becomes short.

10. A temperature controlling method according to claim 8, wherein the heating element is disposed in the vicinity of a nip portion of the support member, and the image borne on the recording material is heated by the heating element through the movement member.

11. A temperature controlling method according to claim 9, wherein, in the case where the recording material of the second width is passed after the recording material of the first width was passed, said controlling step increase the target temperature stepwise according to the number of the passed recording materials of the second width.

12. A temperature controlling method according to claim 7, wherein, in a case where, after elapsing a predetermined time or more from the passing of the recording material of the first width, the recording material of the second width is passed, said controlling step sets a certain target temperature irrespective of the elapsed time and the number of the passed recording materials of the first width, and also makes the predetermined time different according to the number of the passed recording materials of the first width.

13. An image forming apparatus comprising:

image forming means for forming and bearing an unfixed image on a recording material; and heating/fixing means for heating and fixing the unfixed image onto the recording material as a permanent image by holding tight and conveying the recording material bearing the unfixed image at a nip formed between a heating member having a heating element and a pressure member, said heating/fixing means including, a temperature detecting element for detecting a temperature in the vicinity of said heating member, and a control unit for controlling power supply to said heating element so that the temperature in the vicinity of said heating member becomes a target temperature, on the basis of an output from said temperature detecting element, wherein, in a case where, after the recording material of a first width was passed, the recording material of a second width wider than said first width is passed, said control unit sets the target temperature at the time when the recording material of said second width is passed, according to the number of the passed recording materials of said first width and an elapsed time after the recording material of said first width was passed.

14. An image forming apparatus according to claim 13, wherein said heating member includes a flexible movement member and a support member which has a slide surface sliding on said movement member and supports said movement member, and said heating member heats the image borne on the recording material by slidingly moving said movement member on the surface of said support member at the nip and then holding tight and conveying the recording material bearing the image between said movement member and said pressure member at the nip.

15. An image forming apparatus according to claim 13, wherein, in the case where the recording material of said second width wider than said first width is passed after the recording material of said first width was passed, said control unit performs the control so that the target temperature at the time when the recording material of said second width is passed becomes low in proportion as the number of the passed recording materials of said first width becomes large and a time from the end of the passing of the recording material of said first width to the beginning of the passing of the recording material of said second width becomes short.

16. An image forming apparatus according to claim 14, wherein said heating element is disposed in the vicinity of a nip portion of said support member, and the image borne on the recording material is heated by said heating element through said movement member.

17. An image forming apparatus according to claim 15, wherein, in the case where the recording material of said second width is passed after the recording material of said first width was passed, said control unit increase the target temperature stepwise according to the number of the passed recording materials of said second width.

18. An image forming apparatus according to claim 13, wherein, in a case where, after elapsing a predetermined time or more from the passing of the recording material of said first width, the recording material of said second width is passed, said control unit sets a certain target temperature irrespective of the elapsed time and the number of the passed recording materials of said first width, and also makes the predetermined time different according to the number of the passed recording materials of said first width.

* * * * *

UNITED STATES PATENT AND TRADEMARK OFFICE

CERTIFICATE OF CORRECTION

PATENT NO. : 6,862,416 B2
DATED : March 1, 2005
INVENTOR(S) : Shinji Hashiguchi et al.

It is certified that error appears in the above-identified patent and that said Letters Patent is hereby corrected as shown below:

Column 7,
Line 28, “tightly” should read -- tight --.
Line 46, “cross sectional” should read -- cross-sectional --.
Line 61, “RuO2, Ta2N” should read -- $RuO_2$, $Ta_2N$ --.

Column 16,
Line 30, “increase” should read -- increases --.

Column 17,
Line 24, “increase” should read -- increases --.

Signed and Sealed this

Twelfth Day of July, 2005

JON W. DUDAS
*Director of the United States Patent and Trademark Office*